US006995324B2

(12) United States Patent
Asada

(10) Patent No.: US 6,995,324 B2
(45) Date of Patent: Feb. 7, 2006

(54) PUSH-ON SWITCH

(75) Inventor: Makoto Asada, Nara (JP)

(73) Assignee: Hosiden Corporation, Yao (JP)

( * ) Notice: Subject to any disclaimer, the term of this patent is extended or adjusted under 35 U.S.C. 154(b) by 0 days.

(21) Appl. No.: 11/103,543

(22) Filed: Apr. 12, 2005

(65) Prior Publication Data

US 2005/0236264 A1 Oct. 27, 2005

(30) Foreign Application Priority Data

Apr. 21, 2004 (JP) ..... 2004-125521
Nov. 16, 2004 (JP) ..... 2004-331467

(51) Int. Cl.
*H01H 5/30* (2006.01)

(52) U.S. Cl. ..... 200/1 B; 200/406; 200/516

(58) Field of Classification Search ..... 200/1 B, 200/406, 512, 516, 517
See application file for complete search history.

(56) References Cited

U.S. PATENT DOCUMENTS 4,659,881 A * 4/1987 Dowe ..... 200/5 R
4,933,522 A * 6/1990 Celander ..... 200/513
5,898,147 A * 4/1999 Domzalski et al. ..... 200/1 B
6,262,383 B1 * 7/2001 Nishikawa ..... 200/406
6,552,287 B2 4/2003 Janniere
6,639,159 B2 * 10/2003 Anzai ..... 200/1 B
6,693,246 B1 * 2/2004 Rudolph et al. ..... 200/1 B
6,809,272 B2 * 10/2004 Yamada ..... 200/1 B

FOREIGN PATENT DOCUMENTS

| | | |
|---|---|---|
| EP | 1 162 521 A1 | 12/2001 |
| EP | 1 524 679 A1 | 4/2005 |
| JP | 2003-7168 | 1/2003 |
| JP | 2003007168 | 1/2003 |
| WO | WO 00/73886 A1 | 12/2000 |

* cited by examiner

*Primary Examiner*—Michael A. Friedhofer
(74) *Attorney, Agent, or Firm*—Bacon & Thomas, PLLC

(57) ABSTRACT

A two-step push-on switch in which the operating stroke of an upper movable contact is ensured, and particularly the width of the switch is reduced while the durability of the upper movable contact is improved, the number of parts is reduced, an the operation is improved. Dome-like movable contacts are placed in two or upper and lower stages in an invertible manner in a recess of an insulative body having a plurality of stationary contacts, and the upper movable contact is formed into an oval shape.

5 Claims, 3 Drawing Sheets

PUSH-ON SWITCH

BACKGROUND OF THE INVENTION

1. Field of the Invention

The present invention relates to a push-on switch in which a dome-like movable contact is inverted as a result of a depressing operation to make electrical conduction, and more particularly to a two-step push-on switch into which two or upper and lower movable contacts are incorporated.

2. Description of the Prior Art

In a two-step push-on switch into which two or upper and lower movable contacts are incorporated, usually, circular dome-like plate springs are used as the movable contacts. In this case, in order to increase the operation stroke, the movable contacts must have a large external shape, thereby producing a problem in that the whole size of the switch is increased. In a two-step push-on switch, the upper movable contact itself conducts an inverting operation, and a central portion is displaced to a position where the lower movable contact conducts an inverting operation. Therefore, a stress produced in such an upper movable contact during an inverting operation is larger than that produced in a movable contact of a usual one-step push-on switch or a lower movable contact of a two-step push-on switch. Consequently, there arise further problems in that failures such as cracks or deflection (creep) easily occur, and that the life number of ON/OFF operations is reduced. During inverting operations in a two-step push-on switch, deformed shapes of upper and lower movable contacts are similar to each other, and hence it is difficult to definitely obtain senses of two-step operations. Therefore, it is required to employ a structure in which a support member is disposed as another member in a central area between the upper and lower movable contacts, and adjustment must be conducted so as to obtain excellent senses of operations. This structure produces a problem in that the number of parts is increased. As a countermeasure, it has been proposed to realize a switch structure in which a dome-like plate spring having a shape other than a circle is used as an upper movable contact, and a stress during an inverting operation of the upper movable contact is relaxed while ensuring the operation stroke of the movable contact, and the installation area can be reduced.

A specific example of such a two-step push-on switch in which a dome-like plate spring having a shape other than a circle is used as an upper movable contact is disclosed in Japanese Patent Application Laying-Open No. 2003-7168. The proposed switch comprises: a housing having an accommodating portion; a central stationary contact which is disposed on an inner bottom face of the accommodating portion of the housing; a first peripheral stationary contact which is disposed outside the central stationary contact; a second peripheral stationary contact which is disposed outside the first peripheral stationary contact; a dome-like lower movable contact in which a central area of an inflated portion is opposed to the central stationary contact, and a peripheral edge portion is always in contact with the first peripheral stationary contact; and a dome-like upper movable contact which has a diameter larger than the external shape of the lower movable contact, and in which a central area of an inflated portion is opposed to the lower movable contact so as to cover the lower movable contact, and a peripheral edge portion is always in contact with the second peripheral stationary contact. A plurality of arms are crosswise elongated from the upper movable contact so as to be continuous to the invertible inflated portion. In the four diagonal corners of the housing, accommodating recesses in which the arms of the upper movable contact are respectively accommodated in a bendable and stretchable manner are formed so as to be continuous to the accommodating portion. The second peripheral stationary contact which is always in contact with at least one of the arms is placed in the accommodating recesses.

SUMMARY OF THE INVENTION

A problem which is to be solved by the invention is as follows. In the case where a two-step push-on switch is to be mounted in a side face of a thin apparatus such as a portable telephone, for example, the dimensions of the switch, particularly the width must be reduced. When a dome-like cross plate spring is used as an upper movable contact as described above, a square accommodating space is required, and hence size reduction of the width of a switch is limited from the viewpoint of a shape.

By contrast, the invention is characterized in that, in a two-step push-on switch in which dome-like movable contacts are placed in two or upper and lower stages in an invertible manner in a recess of an insulative body having a plurality of stationary contacts, the upper movable contact is formed into an oval shape.

In the invention, preferably, the movable contacts are fixed in an invertible manner to the body respectively by adhesive sheets each of which is bonded from a side of an upper face of corresponding one of the movable contacts, a through hole is formed in a central area of the adhesive sheet which fixes the lower movable contact to the body, a downward projection is disposed in a central area of the upper movable contact, and an upper face of a top portion of the lower movable contact is exposed through the through hole of the adhesive sheet, thereby enabling the upper face to be contacted with the projection of the upper movable contact.

In addition to the above configuration, preferably, added is a configuration having: a central stationary contact which is disposed in a central area of a bottom face of the recess to be opposed to the top portion of the lower movable contact; a first peripheral stationary contact which is disposed outside the central stationary contact, and which is always in contact with an outer peripheral edge portion of the lower movable contact; and a second peripheral stationary contact which is disposed outside the first peripheral stationary contact, and which is always in contact with an outer peripheral edge portion of the upper movable contact that is larger than the lower movable contact.

The invention is characterized also in that, in the upper movable contact, legs are elongated continuously from four corners of an oval portion which is invertible, leg accommodating recesses which accommodate the legs of the upper movable contact are formed in four corners of the body to be continuous to the recess, respectively, and a stationary contact which is always in contact with at least one of the legs is disposed in the leg accommodating recesses.

When this configuration is employed, preferably, the legs elongate from the four corners of the invertible oval portion to be continuous in a longitudinal direction of the oval portion.

According to the invention, the upper movable contact is formed into an oval dome-like shape which is obtained by cutting away both ends of a circular dome-like movable contact in the conventional art. Therefore, it is possible to obtain a two-step push-on switch in which reduction of the dimensions of the switch, particularly the width can be realized while ensuring the operation stroke of the movable contact, and which has a reduced width that enables the switch to be mounted even in a side face of a thin apparatus such as a portable telephone. In the upper movable contact having an oval dome-like shape, even when the central area is largely displaced as a result of depression, a stress produced in the movable contact is more relaxed as compared with that applied to a circular dome-like movable contact in the conventional art. Therefore, the invention can provide a two-step push-on switch which can attain effects such as that occurrence of failures such as cracks or deflection is suppressed, that the life number of ON/OFF operations is remarkably increased, and that the life period is longer than that of a conventional switch.

In the case where the switch is configured so that the movable contacts are fixed in an invertible manner to the body respectively by adhesive sheets each of which is bonded from the side of the upper face of corresponding one of the movable contacts, the through hole is formed in the central area of the adhesive sheet which fixes the lower movable contact to the body, the downward projection is disposed in the central area of the upper movable contact, and the upper face of the top portion of the lower movable contact is exposed through the through hole of the adhesive sheet, thereby enabling the upper face to be contacted with the projection of the upper movable contact, the upper movable contact and the lower movable contact can be directly contacted with each other so as to attain electrical conduction, although the lower movable contact is simply bonded and fixed to the body by the adhesive sheet. Moreover, the downward projection disposed in the central area of the upper movable contact plays the role of a support member which, in the conventional art, is disposed as another member in a central area between upper and lower movable contacts in order to definitely obtain senses of two-step operations. Therefore, it is possible to obtain excellent senses without increasing the number of parts. Consequently, this configuration is effective.

In the case where the body has: the central stationary contact which is disposed in the central area of the bottom face of the recess to be opposed to the top portion of the lower movable contact; the first peripheral stationary contact which is disposed outside the central stationary contact, and which is always in contact with the outer peripheral edge portion of the lower movable contact; and the second peripheral stationary contact which is disposed outside the first peripheral stationary contact, and which is always in contact with the outer peripheral edge portion of the upper movable contact that is larger than the lower movable contact, it is possible to obtain a two-step push-on switch in which the upper movable contact is first inverted by a depressing operation, so that the downward projection disposed in the central area of the upper movable contact is in contact with the lower movable contact, whereby the second peripheral stationary contact and the first peripheral stationary contact are electrically connected to each other to obtain an operation sense and electrical conduction of the first step, or the first-step switch enters an ON state while producing an operation sense, and the lower movable contact is then inverted to be in contact with the central stationary contact, whereby the first peripheral stationary contact and the central stationary contact are electrically connected to each other to obtain an operation sense and electrical conduction of the second step, or the second-step switch enters an ON state while producing an excellent operation sense. Consequently, this configuration is effective.

In the case where, in the upper movable contact, the legs are elongated continuously from four corners of the oval portion which is invertible, the leg accommodating recesses which accommodate the legs of the upper movable contact are formed in four corners of the body to be continuous to the recess, respectively, and the stationary contact which is always in contact with at least one of the legs is disposed in the leg accommodating recesses, the legs are provided with a spring property, thereby enabling the movable contact to be always in electric contact with the stationary contact (the second peripheral stationary contact) in both a no-load condition (both the first- and second-step switches are turned OFF) and a case where a load causing a large displacement amount is applied (the second-step switch is turned ON). When the stationary contact is grounded, a sure countermeasure against static electricity can be performed, and hence the invention is effective.

When the legs elongate from the four corners of the invertible oval portion to be continuous in the longitudinal direction of the oval portion, sure conduction can be attained while realizing reduction of the width of the switch. Consequently, this configuration is further effective.

DETAILED DESCRIPTION OF THE PREFERRED EMBODIMENTS

In a push-on switch in which a dome-like movable contact is inverted as a result of a depressing operation to make electrical conduction, and more particularly in a two-step push-on switch into which two or upper and lower movable contacts are incorporated, a two-step push-on switch structure was realized in which the operation sense can be improved while improving the durability of the upper movable contact and reducing the number of parts, and the width of the switch is reduced while ensuring the operation stroke of the movable contact.

Figure 1:
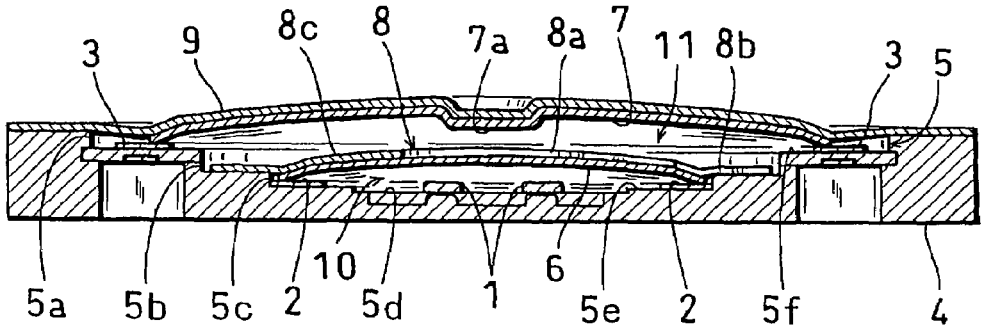
FIG. 1 is a section view of a two-step push-on switch showing a first embodiment of the invention.
Figure 2:
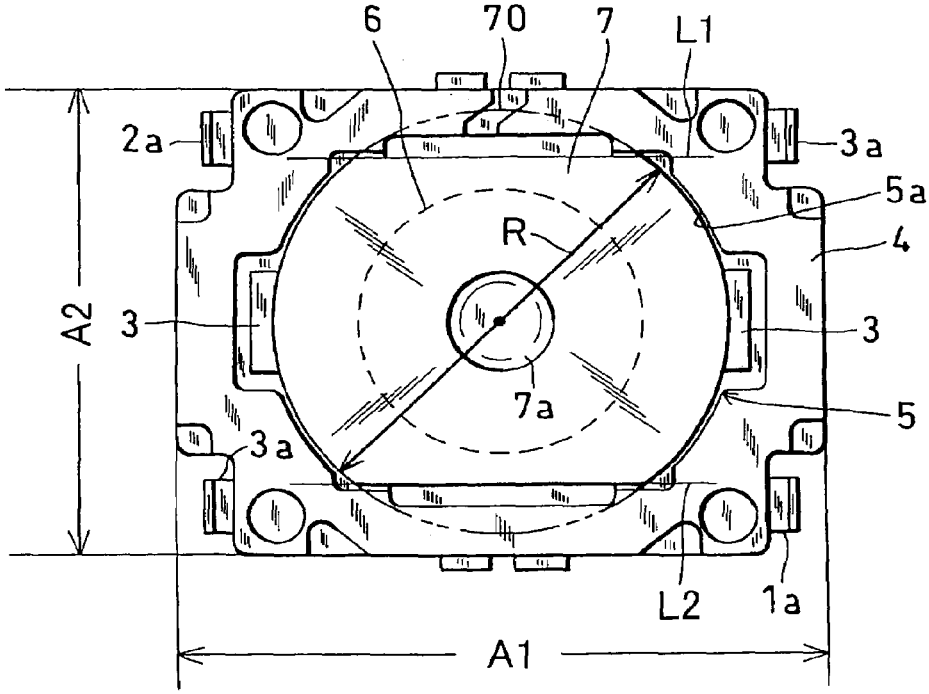
FIG. 2 is a plan view showing a state where an upper adhesive sheet in the switch shown in FIG. 1 is removed away.
Figure 3:
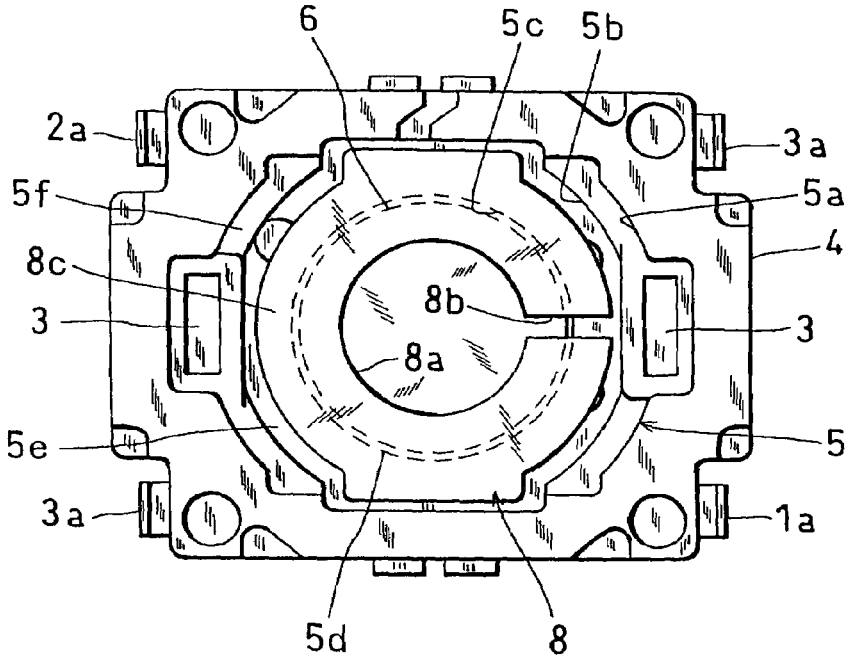
FIG. 3 is a plan view showing a state where an upper movable contact in the switch shown in FIG. 2 is removed away.

Hereinafter, a first embodiment of the invention will be described with reference to FIGS. 1 to 3. FIG. 1 is a section view of a push-on switch of the first embodiment, FIG. 2 is a plan view showing a state where an upper adhesive sheet in the switch shown in FIG. 1 is removed away, and FIG. 3 is a plan view showing a state where an upper movable contact in the switch shown in FIG. 2 is removed away.

The push-on switch of the embodiment will be schematically described. In the switch, two dome-like movable contacts 6, 7 having different sizes and shapes are placed in two or upper and lower stages in a recess 5 of a body 4 having a plurality of stationary contacts 1, 2, 3, and the movable contacts 6, 7 are fixed in an invertible manner to the body 4 respectively by adhesive sheets 8, 9 each of which is bonded from the side of the upper face of corresponding one of the movable contacts, thereby configuring a two-step push-on switch.

Then, the configurations of the components of the push-on switch of the embodiment will be described in detail. The body 4 is made of an insulating material such as a synthetic resin, and formed into a shallow box-like structure (tray-like structure) which has an internally formed recess 5, which has a substantially rectangular external shape, and in which the upper face is opened.

The recess 5 of the body 4 is configured by: an upper recess 5*a*which is formed by recessing the upper face of the body 4 by one step into an substantially oval shape while not recessing the outer peripheral edge portion; a middle recess 5*b* which is formed by recessing the bottom face of the upper recess 5*a* by one step into an substantially oval shape while not recessing both end portions of the bottom face in the longitudinal direction of the body 4; and a lower recess 5*c* which is formed by recessing the bottom face of the middle recess 5*b* by one step into a circular shape while not recessing the outer peripheral edge portion. The recesses 5*a*, 5*b*, 5*c* are located concentric with the center of the body 4. The upper and middle recesses 5*a*, 5*b* having an substantially oval shape are formed in the body 4 so that their both arcuate end portions are opposed to one set of short sides which are opposed to each other in the longitudinal direction of the body 4, and their both linear side edges are parallel to the long sides which are opposed to each other in the lateral direction of the body 4. According to the configuration, a recess middle bottom face 5*d* (the bottom face of the lower recess 5*c*) which is horizontal and circular is formed at the middle of the deepest portion of the recess 5. A first recess peripheral bottom face 5*e* (the outer peripheral edge portion of the bottom face of the middle recess 5*b*) which is horizontal and substantially annular is formed at a position which is in the periphery of the recess middle bottom face 5*d*, and which is higher in level by one step than the recess middle bottom face. A second recess peripheral bottom face 5*f* (both end portions of the bottom face of the upper recess 5*a* in the longitudinal direction of the body 4) which is horizontal and arcuate is formed at two positions which are in both outer sides of the first recess peripheral bottom face 5*e* in the longitudinal direction of the body 4, opposed to each other across the middle recess 5*b* in the longitudinal direction of the body 4, and higher in level by one step than the first recess peripheral bottom face 5*e*.

The stationary contacts 1, 2, 3 provided on the body 4 are made of a metal material which is electrically conductive, and attached integrally to the body 4 by insert molding or the like during a process of molding the body 4. The stationary contacts are configured respectively as: a middle stationary contact 1 which is disposed in a middle portion of the recess middle bottom face 5*d* serving as the bottom face middle portion of the recess 5, in a state where one end portion is exposed; first peripheral stationary contacts 2 which are disposed at symmetric positions of the outer peripheral edge portion of the recess middle bottom face 5*d* serving as two positions which are outside the middle stationary contact 1 and opposed to each other across the middle stationary contact in the lateral direction of the body 4, in a state where one end portion is exposed; and second peripheral stationary contacts 3 which are disposed on the center line of the second recess peripheral bottom face 5*f* in the longitudinal direction of the body 4, and at two positions which are outside the first peripheral stationary contacts 2 and opposed to each other across the middle recess 5*b* in the longitudinal direction of the body 4, in a state where one end portion is exposed. Four end portions of the stationary contacts in total, or another end portion of the middle stationary contact 1, a common other end portion of the first peripheral stationary contacts 2, and other end portions of the second peripheral stationary contacts 3 are drawn out respectively from four end portions of one set of short side faces which are opposed to each other in the longitudinal direction of the body 4, to protrude to the outside of the body 4, thereby forming external contacts 1*a*, 2*a*, 3*a* for a circuit board of an apparatus.

The lower movable contact 6 is configured by a metal plate spring which is electrically conductive, and formed into a dome-like shape which is circular, which has a diameter that is slightly smaller than that of the lower recess 5*c*, and which is upward inflatingly curved. The lower movable contact 6 is formed so that the center top portion is higher than the depth of the lower recess 5*c*, and lower than the total depth of the lower recess 5*c* and the middle recess 5*b*.

By contrast, the upper movable contact 7 is configured in the same manner as the lower movable contact 6 by a metal plate spring which is electrically conductive, but formed into a dome-like shape which has a size that enables the upper movable contact to cover the lower movable contact 6 from the upper side, which is oval unlike the lower movable contact 6, and which is upward inflatingly curved. More specifically, the upper movable contact 7 is configured in the following manner. The upper movable contact has a diameter R which is larger at least than the diameter of the lower movable contact 6, and smaller than the width A1 of the longitudinal side of the body 4 (in the embodiment, the upper movable contact having a diameter R which is larger than the diameter of the lower movable contact 6, and smaller than the width A2 of the lateral side of the body 4 is shown). The upper movable contact is formed into an oval shape in which edge portions of a dome-like disc 70 (see the phantom lines in FIG. 2) that is upward inflatingly curved are cut away by two parallel lines L1, L2 that are parallel to one set of longitudinal sides opposed to each other in the lateral direction of the body 4, and that have a relative distance which is smaller than the relative distance between the longitudinal sides, i.e., the width A2 of the lateral side of the body 4, and larger than the diameter of the lower movable contact 6. The upper movable contact is formed so as to be placeable in the upper recess 5*a* of the body 4 in a direction (posture) in which, in a plan view, the linear cut edges of the upper movable contact 7 elongate along the one set of longitudinal sides opposed in the lateral direction of the body 4, and the arcuate uncut edges are opposed to the one set of lateral sides opposed in the longitudinal direction of the body 4. The upper movable contact 7 is formed so that the center top portion is higher than the depth of the upper recess 5*a*, and a circular projection 7*a* which downward projects is formed integrally in a central area of the upper movable contact 7.

The lower adhesive sheet 8 which fixes the lower movable contact 6 to the body 4 in an invertible manner is obtained by forming an adhesive layer on one face of a resin-made sheet which is flexible, elastic, and insulative, and formed into a C-like shape. More specifically, the adhesive sheet 8 is an adhesive sheet in which a circular through hole 8*a* having a diameter that is smaller than that of the lower movable contact 6 and larger than the projection 7*a* of the upper movable contact 7 is concentrically formed in a central area of a circular adhesive sheet having a diameter enabling the sheet to cover the lower movable contact 6 and the outer peripheral edge portion to be bonded to the first recess peripheral bottom face 5*e* of the body 4, and one thin cutaway 8*b* which extends from the outer peripheral edge to reach the through hole 8*a* is radially formed in a part of the circular annular portion of the adhesive sheet that is annularly formed, whereby the adhesive sheet is formed into a non-annular or C-like shape. The adhesive sheet has the through hole 8*a* in the central area, and a C-like non-annular portion 8*c* in which the portion surrounding the through hole 8*a* is interrupted by the cutaway 8*b*. The non-annular portion 8*c* is bonded to both the outer peripheral edge portion of the lower movable contact 6 and an inner peripheral edge portion of the first recess peripheral bottom face 5*e* of the body 4 surrounding the outer peripheral edge portion. The circumferential bonding range is not the whole peripheries of the outer peripheral edge portion of the lower movable contact 6 and the inner peripheral edge portion of the first recess peripheral bottom face 5*e* of the body 4 surrounding the outer peripheral edge portion, but is positively interrupted by the cutaway 8*b*.

In the same manner as the lower movable contact 6, the upper adhesive sheet 9 which fixes the upper movable contact 7 to the body 4 in an invertible manner is obtained by forming an adhesive layer on one face of a resin-made sheet which is flexible, elastic, and insulative. The upper adhesive sheet 9 is formed into a substantially rectangular shape having a size enabling the sheet to cover the upper movable contact 7, and an outer peripheral edge portion to be bonded to an outer peripheral edge portion of the upper face of the body 4 which remains in the periphery of the upper recess 5*a*.

Next, the manner of assembling the push-on switch of the embodiment will be described. First, the lower movable contact 6 having a circular dome-like shape is fitted in an upward inflated posture into the circular lower recess 5*c* which is the deepest portion of the recess 5 of the body 4, to be placed above the recess middle bottom face 5*d*. Thereafter, the adhesive sheet 8 having a C-like shape is bonded from the side of the upper face of the lower movable contact 6 to the upper face of the outer peripheral edge portion and the inner peripheral edge portion of the first recess peripheral bottom face 5*e* of the body 4 surrounding the outer peripheral edge portion so that the non-annular portion 8*c* extends over the upper face of the outer peripheral edge portion of the lower movable contact 6 and the inner peripheral edge portion of the first recess peripheral bottom face 5*e* of the body 4 surrounding the outer peripheral edge portion, thereby causing the lower movable contact 6 to be fixed to the bottom portion of the recess 5 of the body 4 by the lower adhesive sheet 8 in an invertible manner. Then, the upper movable contact 7 having an oval dome-like shape is fitted in an upward inflated posture into the substantially oval upper recess 5*a* serving as an upper opening (the shallowest portion) of the recess 5 of the body 4, to be placed above the second recess peripheral bottom face 5*f*. Thereafter, the upper adhesive sheet 9 having a substantially rectangular shape is bonded from the side of the upper face of the upper movable contact 7 to the upper face and the upper face outer peripheral edge portion of the body 4 surrounding the upper face so as to integrally cover the upper movable contact 7 and the upper face outer peripheral edge portion of the body 4 surrounding the upper movable contact to close the recess 5, thereby causing the upper movable contact 7 to be fixed to the upper opening of the recess 5 of the body 4 by the upper adhesive sheet 9 in an invertible manner. According to the configuration, the two-step push-on switch is assembled in a state where the two or upper and lower movable contacts 6, 7 are accommodated and concentrically placed in two or upper and lower stages in the recess 5 of the body 4 with forming a predetermined gap, the top of the central area of the lower movable contact 6 is separated and opposed above the middle stationary contact 1 of the body 4, the outer peripheral edge portion of the lower movable contact 6 is always in contact with the first peripheral stationary contacts 2 of the body 4, the downward projection 7*a* of the central area of the upper movable contact 7 is separated and opposed above the central area of the lower movable contact 6, and the arcuate uncut edges of the upper movable contact 7 are always in contact with the second peripheral stationary contacts 3 of the body 4.

Since the lower adhesive sheet 8 which fixes the lower movable contact 6 to the body 4 in an invertible manner is formed into a C-like shape, the upper face of the top portion of the central area of the lower movable contact 6 is exposed through the through hole 8*a* of the lower adhesive sheet 8, and the downward projection 7*a* of the central area of the upper movable contact 7 is separated from and opposed to the exposed portion. As a result, the top of the central area of the lower movable contact 6 and the downward projection 7*a* of the central area of the upper movable contact 7 can be directly contacted with each other. In the recess 5 of the body 4 in which the stationary contacts 1, 2, 3 and the movable contacts 6, 7 are accommodated, the opening is closed by the upper adhesive sheet 9. Therefore, the recess is formed as a sealed space, so that dusts which may cause a contact failure in contacts is prevented from entering, and the sealed spaced is partitioned into two or upper and lower layers by the lower adhesive sheet 8 and the lower movable contact 6. Since the lower adhesive sheet 8 which fixes the lower movable contact 6 to the body 4 in an invertible manner is formed into a C-like shape, the small space below the lower adhesive sheet 8 and the lower movable contact 6, i.e., a space 10 between the recess middle bottom face 5*d* of the body 4 and the lower movable contact 6 communicates with a large space above the lower adhesive sheet 8 and the lower movable contact 6, i.e., a space 11 between the lower movable contact 6 and the upper movable contact 7, through the cutaway 8*b* by which the lower adhesive sheet 8 is formed into a non-annular shape.

Usually, a body which accommodates a circular dome-like movable contact having a diameter of R must be formed into a square shape having sides of A1. By contrast, since the upper movable contact 7 is formed into an oval shape, the width of the body 4 in the lateral direction of the upper movable contact 7 can be made smaller than the width of the upper movable contact 7 in the longitudinal direction (A1>A2), while ensuring the same operation stroke as a circular dome-like movable contact having a diameter of R. In the assembled two-step push-on switch, therefore, the dimension in the width direction can be reduced.

The two-step push-on switch which is assembled as described above is surface-mounted in a state where the external contacts 1*a*, 2*a*, 3*a* protruding from the body 4 are electrically connected by soldering to contacts formed on a circuit board of an apparatus such as an electronic apparatus or communication apparatus, to be mounted on the apparatus. Since the dimensions, particularly the width are reduced, the switch can be mounted even in a side face of a thin apparatus such as a portable telephone.

Next, the operation of the push-on switch of the embodiment will be described. In a state where the switch is not depressed, the upper movable contact 7 is returned to an upward inflated dome-like shape as shown in FIG. 1, and the arcuate uncut edges are in contact with the second peripheral stationary contacts 3 to attain electrical conduction. However, the downward projection 7*a* in the central area is separated from the lower movable contact 6. Also the lower movable contact 6 is returned to an upward inflated dome-like shape, and the outer peripheral edge portion is in contact with the first peripheral stationary contacts 2 to attain electrical conduction. However, the top of the central area is separated from the middle stationary contact 1. Therefore, both the two or upper and lower step switches are in the OFF state.

In the state of FIG. 1, then, the center area of the upper movable contact 7 is downward depressed from the side above the upper adhesive sheet 9 by an operating member such as a key top. When the center area of the upper movable contact 7 cannot withstand the depressing force, the upper movable contact 7 is rapidly inverted to a downward inflated state, and the lower face of the downward projection 7*a* of the central area is directly contacted with the upper face of the top portion of the central area of the lower movable contact 6 which is exposed through the through hole 8*a* of the lower adhesive sheet 8, so that the upper movable contact 7 and the lower movable contact 6 are electrically connected to each other. The second peripheral stationary contacts 3 and the first peripheral stationary contacts 2 are connected to each other through the upper and lower movable contacts 7 and 6 which are in the electrically conductive state, thereby causing the first-step (upper) switch to enter the ON state with producing an operation sense.

When, in the state where the first-step switch is turned ON as described above, the center area of the upper movable contact 7 is further downward depressed from the side above the upper adhesive sheet 9 by the operating member, the upper face of the top portion of the central area of the lower movable contact 6 is downward depressed by the lower face of the downward projection 7*a* of the central area of the upper movable contact 7. When the center area of the lower movable contact 6 cannot withstand the depressing force, the lower movable contact 6 is rapidly inverted to a downward inflated state, and the lower face of the center area makes contact with the middle stationary contact 1, and the first peripheral stationary contacts 2 and the middle stationary contact 1 are connected to each other through the lower movable contact 6, thereby causing the second-step (lower) switch to enter the ON state with producing an operation sense.

When, in the state where the second-step switch is turned ON as described above, the depressing force which is applied to the upper movable contact 7 by the operating member is cancelled, first, the central area of the lower movable contact 6 is returned to its initial state or the upward inflated dome-like shape by the elasticity of itself, to attain a state where the top of the central area is separated from the middle stationary contact 1. Then, the central area of the upper movable contact 7 is returned to its initial state or the upward inflated dome-like shape by the elasticity of itself, to attain a state where the downward projection 7*a* of the central area is separated from the lower movable contact 6. As a result, both the upper- and lower-step switches enter the OFF state.

When, in the two-step push-on switch, the second-step switch is transferred from the OFF state to the ON state in succession to the first-step switch, or when the central area of the lower movable contact 6 is inverted from the upward inflated dome-like shape to the downward inflated shape, the lower space 10 between the recess middle bottom face 5*d* of the body 4 and the lower movable contact 6 is reduced so that the pressure of the lower space 10 tries to be raised higher than the atmospheric pressure. However, the lower space 10 communicates with the upper space 11 between the lower movable contact 6 and the upper movable contact 7, through the cutaway 8*b* by which the lower adhesive sheet 8 is formed into a non-annular shape. In accordance with the reduction of the lower space 10, therefore, the air in the lower space 10 escapes to the upper space 11, and hence the pressure of the lower space 10 is hardly raised higher than the atmospheric pressure. By contrast, when the second-step switch is transferred from the ON state to the OFF state, or when the central area of the lower movable contact 6 is returned from the downward inflated shape to the initial shape or the upward inflated dome-like shape, the air in the upper space 11 is sucked into the lower space 10 in accordance with the expansion of the lower space 10, and hence the pressure of the lower space 10 is not reduced lower than the atmospheric pressure. In this way, the air flows into and from the lower space 10 are enabled so as to maintain the pressure of the lower space 10 to the atmospheric pressure, whereby the operation characteristics of the lower movable contact 6 can be sufficiently exerted so that an excellent operation sense can be obtained when the lower movable contact 6 operates.

In the central area of the upper movable contact 7, the circular projection 7*a* which downward projects is integrally formed. Therefore, the deformation shape (displacement amount) when the first-step switch of the two-step push-on switch is transferred from the ON state to the OFF state, or when the central area of the upper movable contact 7 is inverted from the upward inflated dome-like shape to the downward inflated shape is smaller than the deformation shape (displacement amount) when the second-step switch of the two-step push-on switch is transferred from the OFF state to the ON state, or when the central area of the lower movable contact 6 is inverted from the upward inflated dome-like shape to the downward inflated shape. The difference in deformation shape (displacement amount) between the upper movable contact 7 and the lower movable contact 6 can produce a difference between the operation sense of the first-step switch and that of the second-step switch, whereby senses of two-step operations can be definitely obtained. Moreover, the projection 7*a* which is used for definitely obtaining senses of two-step operations is not disposed as a separate member dedicated to this purpose, but is formed integrally with the central area of the upper movable contact 7. Therefore, the number of parts is not increased.

The upper movable contact 7 is formed into an oval shape in which edge portions of the circular dome-like disc 70 (see the phantom lines in FIG. 2) are cut away by the two parallel lines L1, L2. Even in the case where, when a depressing operation is applied so as to cause the second-step switch to be turned ON, the central area of the upper movable contact 7 is largely displaced, therefore, a stress produced in the upper movable contact 7 is relaxed (as compared with the case of a circular dome-like movable contact), whereby failures such as cracks or deflection (creep) are prevented from occurring and the life number of ON/OFF operations is remarkably increased.

As described above, the two-step push-on switch of the embodiment has a structure in which the dome-like movable contacts 6, 7 are placed in two or upper and lower stages in the recess 5 of the insulative body 4 having the plural contacts 1, 2, 3, and the movable contacts 6, 7 are fixed in an invertible manner to the body 4 by the adhesive sheets 8, 9 that are bonded respectively to the movable contacts from the upper face side, and comprises air releasing means (the cutaway 8*b*) for enabling the space 10 between the inner bottom face (the recess middle bottom face 5*d*) of the body 4 and the lower movable contact 6 to communicate with the space 11 between the lower movable contact 6 and the upper movable contact 7. When the lower movable contact 6 is inverted, the air between the inner bottom face (the recess middle bottom face 5*d*) of the body 4 and the lower movable contact 6 is caused to escape into the space 11 between the lower movable contact 6 and the upper movable contact 7. By contrast, when a depressing operation is cancelled and the lower movable contact 6 is returned to the original or dome-like shape, the air between the lower movable contact 6 and the upper movable contact 7 is sucked into the space 10 between the inner bottom face (the recess middle bottom face 5*d*) of the body 4 and the lower movable contact 6. Since such air flows are enabled, the operation sense of the lower movable contact 6 is not impaired, and an excellent sense can be obtained although the lower movable contact 6 is simply bonded and fixed to the body 4 by the adhesive sheet 8.

The air releasing means may be a cutaway or an air hole which passes through the lower movable contact 6. In the case where the means is the cutaway 8*b* disposed in the outer peripheral edge portion of the adhesive sheet 8 for fixing the lower movable contact 6 to the body 4, the operation characteristics of the lower movable contact 6, and the electrical conduction property based on the contact with the upper movable contact 7 are not impaired.

The through hole 8*a* is disposed in the central area of the adhesive sheet 8 for fixing the lower movable contact 6 to the body 4, the upper face of the top portion of the lower movable contact 6 is exposed through the through hole Ba so as to be contactable with the upper movable contact 7, the cutaway 8*b* which extends from the outer peripheral edge of the adhesive sheet 8 to reach the through hole 8*a* is disposed, and the cutaway 8*b* which forms the adhesive sheet 8 into a non-annular shape is used as the air releasing means. Although the lower movable contact 6 is simply bonded and fixed to the body 4 by the adhesive sheet 8, therefore, the upper movable contact 7 and the lower movable contact 6 can be directly contacted with each other to attain electrical conduction. Moreover, the operation characteristics of the lower movable contact 6 are not impaired, and an excellent sense can be obtained.

In the two-step push-on switch of the embodiment, in the structure in which the dome-like movable contacts 6, 7 are placed in an invertible manner in two or upper and lower stages in the recess 5 of the insulative body 4 having the plural contacts 1, 2, 3, the upper movable contact 7 is formed into an oval shape. Since the upper movable contact 7 is formed into an oval dome-like shape which is obtained by cutting away both ends of the circular dome-like disc 70, reduction of the width of the switch is particularly realized while ensuring the operation stroke of the upper movable contact 7. Therefore, it is possible to obtain a two-step push-on switch having a reduced width which enables the switch to be mounted even in a side face of a thin apparatus such as a portable telephone. Even in the case where, when the upper movable contact 7 having an oval dome-like shape is depressed, the central area is largely displaced, a stress produced in the upper movable contact 7 is relaxed as compared with the case of a circular dome-like movable contact, so that it is possible to obtain a two-step push-on switch in which failures such as cracks or deflection are prevented from occurring, the life number of ON/OFF operations is remarkably increased, and the life period is prolonged.

The movable contacts 6, 7 are fixed in an invertible manner to the body 4 by the adhesive sheets 8, 9 that are bonded respectively to the movable contacts from the upper face side, the through hole 8*a* is disposed in the central area of the adhesive sheet 8 for fixing the lower movable contact 6 to the body 4, the downward projection 7*a* is disposed in the central area of the upper movable contact 7, and the upper face of the top portion of the lower movable contact 6 is exposed through the through hole 8*a* of the adhesive sheet 8 to be enabled to be in contact with the projection 7*a* of the upper movable contact 7, whereby the upper movable contact 7 and the lower movable contact 6 can be directly contacted with each other to attain electrical conduction although the lower movable contact 6 is simply bonded and fixed to the body 4 by the adhesive sheet 8. Moreover, the downward projection 7*a* disposed in the central area of the upper movable contact 7 plays the role of a support member which, in the conventional art, is disposed as another member in a central area between the upper and lower movable contacts 6, 7 in order to definitely obtain senses of two-step operations. Therefore, it is possible to obtain excellent senses without increasing the number of parts.

The two-step push-on switch of the embodiment has a structure in which the dome-like movable contacts 6, 7 are placed in an invertible manner in two or upper and lower stages in the recess 5 of the insulative body 4. In the body 4, disposed are: the central stationary contact 1 which is disposed in the central area of the bottom face (the recess middle bottom face 5*d*) of the body 4 to be opposed to the top of the lower movable contact 6; the first peripheral stationary contacts 2 which are disposed outside the central stationary contact 1, and which are always in contact with the outer peripheral edge portion of the lower movable contact 6; and the second peripheral stationary contacts 3 which are disposed outside the first peripheral stationary contacts 2, and which are always in contact with the outer peripheral edge portion of the upper movable contact 7 that is larger than the lower movable contact 6. Therefore, it is possible to obtain a two-step push-on switch in which the upper movable contact 7 is first inverted by a depressing operation to be in contact with the lower movable contact 6, whereby the second peripheral stationary contacts 3 and the first peripheral stationary contacts 2 are electrically connected to each other to obtain an operation sense and electrical conduction of the first step, or the first-step switch enters the ON state while producing an operation sense. Then, the lower movable contact 6 is inverted to be in contact with the central stationary contact 1, whereby the first peripheral stationary contacts 2 and the central stationary contact 1 are electrically connected to each other to obtain an operation sense and electrical conduction of the second step, or the second-step switch enters the ON state while producing an excellent operation sense.

Figure 4:
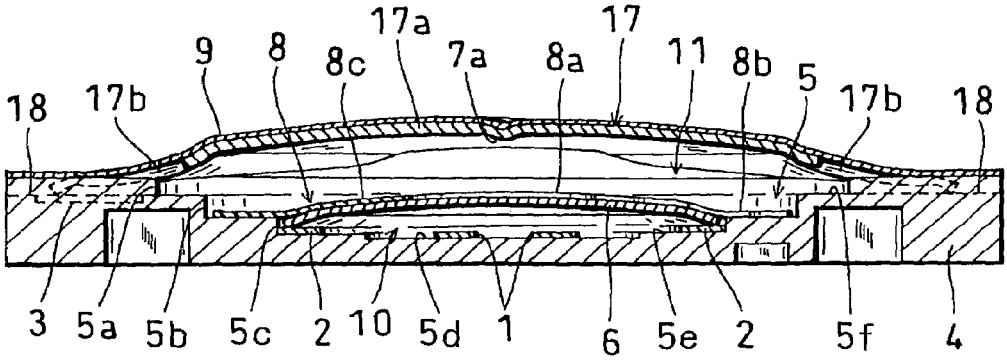
FIG. 4 is a section view of a two-step push-on switch showing a second embodiment of the invention.
Figure 5:
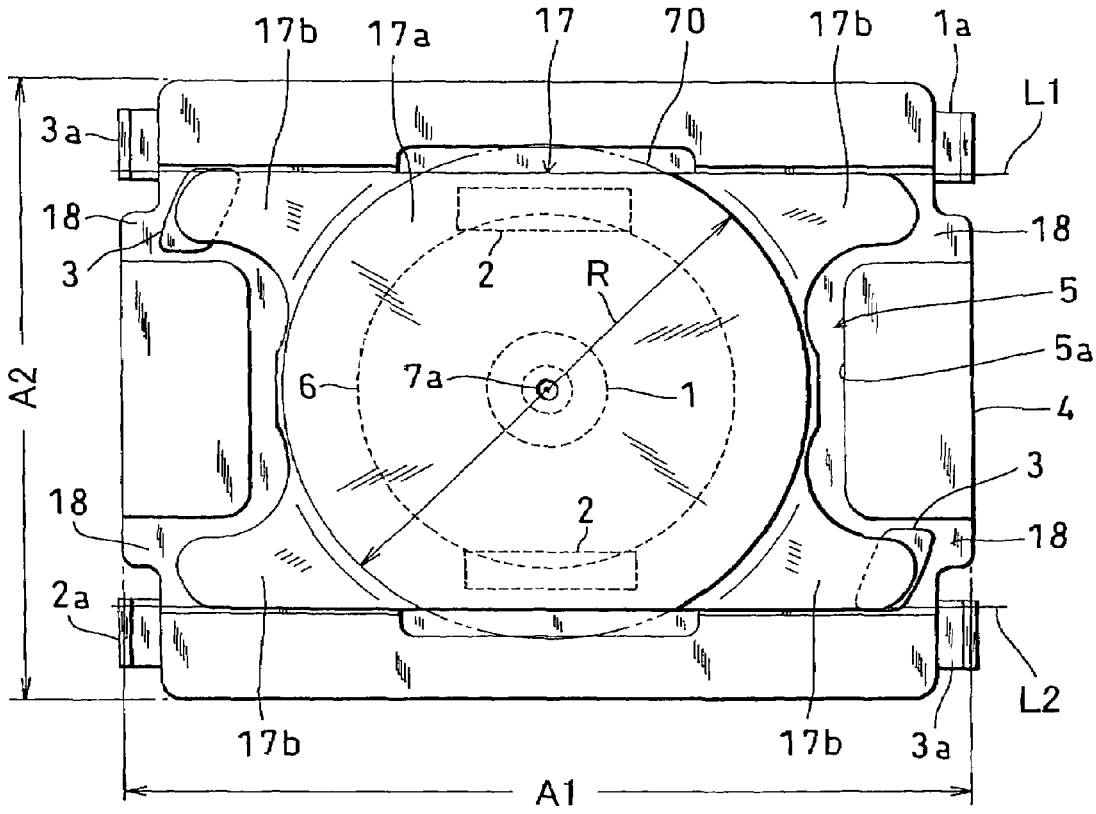
FIG. 5 is a plan view showing a state where an upper adhesive sheet in the switch shown in FIG. 4 is removed away.

Next, a second embodiment of the invention will be described with reference to FIGS. 4 and 5. FIG. 4 is a section view of a push-on switch of the second embodiment, and FIG. 5 is a plan view of the switch showing a state where an upper adhesive sheet shown in FIG. 4 is removed away. The components identical with those of the push-on switch of the first embodiment are denoted by the same reference numerals, and their description is omitted.

In the push-on switch of the second embodiment, an upper movable contact 17 is different from the upper movable contact 7 of the push-on switch of the first embodiment. The movable contact 17 of the push-on switch of the second embodiment is configured by continuously elongating legs 17*b* from four corners of the invertible upper movable contact 7 of the push-on switch of the first embodiment. Specifically, the upper movable contact is configured by: an invertible oval portion 17*a* which is a body of the upper movable contact that, in the same manner as the upper movable contact 7 of the push-on switch of the first embodiment, has an oval shape and is formed into an upward inflatingly curved dome-like shape; and the four legs 17*b* which elongate from the four corners of the oval portion 17*a* to be continuous in the longitudinal direction. In the four corners of the body 4, leg accommodating recesses 18 in which the legs 17*b* of the upper movable contact 17 are respectively accommodated in a bendable and stretchable manner are formed so as to be continuous to the recess 5 of the body 4, in accordance with the upper movable contact 17. Specifically, the leg accommodating recesses 18 are projectingly formed from the four corners of the upper recess 5*a* of the body 4 so as to be continuous in the longitudinal direction. The upper movable contact 17 having the legs 17*b* in the four corners is fitted into the upper recess 5*a* having the leg accommodating recesses 18 in the four corners, to be accommodated in the upper recess 5*a* in a state where the tip ends of the legs 17*b* are butted against and supported by the bottom faces of the leg accommodating recesses 18 which are continuous to the four corners of the second recess peripheral bottom face 5*f*, and fixed in an invertible manner to the upper opening (the upper recess 5*a*) of the recess 5 of the body 4 by the upper adhesive sheet 9. Moreover, stationary contacts which are always in contact with at least one of the legs 17*b*, i.e., the second peripheral stationary contacts 3 are disposed in the leg accommodating recesses 18. Namely, the second peripheral stationary contacts 3 are respectively disposed in the bottom surfaces of the leg accommodating recesses 18 in which two legs 17*b* positioned on a diagonal line of the upper movable contact 17 are respectively accommodated, in a state where one end portion is exposed, and the upper movable contact 17 is always in contact with the second peripheral stationary contacts 3 via two legs 17*b*. The external contact 3*a* for the second peripheral stationary contacts 3 is connected by soldering to a grounding conductor of the circuit board, so that the upper movable contact 17 is always grounded through the second peripheral stationary contacts 3.

In the case where, as in the push-on switch of the second embodiment, the legs 17*b* are elongated in the upper movable contact 17 continuously from the four corners of the oval portion 17*a* which is invertible, the leg accommodating recesses 18 which accommodate the legs 17*b* of the upper movable contact 17 are formed in four corners of the body 4 to be continuous to the recess 5, respectively, and the stationary contacts 3 which are always in contact with at least one of the legs 17*b* are disposed in the leg accommodating recesses 18, the legs 17*b* are provided with a spring property, whereby the contact following property (contact performance) of the contact portions (the legs 17*b*) with respect to the stationary contacts 3 when the upper movable contact 17 is inverted or returned is improved, and momentary interruption can be prevented from occurring, so that the upper movable contact 17 is always in electric contact with the stationary contacts (the second peripheral stationary contacts) 3 in both a no-load condition (both the first- and second-step switches are turned OFF) and a case where a load causing a large displacement amount is applied (the second-step switch is turned ON). Since the stationary contacts 3 are grounded, a sure countermeasure against static electricity can be performed. The legs 17*b* are effective also in improvement of the operation sense of the upper movable contact 17, and assurance of the operation stroke.

Since the legs 17*b* elongate from the four corners of the invertible oval portion 17*a* to be continuous in the longitudinal direction of the oval portion, sure conduction can be attained while realizing reduction of the width of the push-on switch.

The two legs 17*b* which are on a diagonal line of the upper movable contact 17 are caused to be in contact with the stationary contacts 3. Even when a peripheral portion which is deviated from the central area of the upper movable contact 17 is depressed, therefore, contact is attained in at least one set of the leg 17*b* and the stationary contact 3. Therefore, the embodiment is effective in realizing more ensured conductance.

What is claimed is:

1. A push-on switch, including:

an insulative body defining a recess in which a plurality of stationary contacts are situated; and a pair of dome-like movable contacts situated in said recess forming upper and lower stages in an invertible manner, said upper dome-like movable contact being formed into an oval shape, wherein:

said upper dome-like movable contact having an elongated leg which extends continuously from each of the four corners along a width direction of an oblong shape;

said insulative body defining leg accommodating recesses which accommodate a respective leg of said upper dome-like movable contact, said leg accommodating recesses being continuous with said recess in said insulative body; and a stationary contact disposed in each leg accommodating recess and always in contact with at least one of said elongated legs.

2. The push-on switch according to claim 1, wherein:

said dome-like movable contacts are fixed in an invertible manner to said insulative body respectively by adhesive sheets each of which is bonded from a side of an upper face of a corresponding one of said dome-like movable contacts;

a through hole is formed in a central area of said adhesive sheet which fixes said lower dome-like movable contact to said insulative body;

a downward projection is disposed in a central area of said upper dome-like movable contact; and an upper face of a top portion of said dome-like lower movable contact is exposed through said through hole of said adhesive sheet, thereby enabling said upper face to be contacted with said projection of said upper dome-like movable contact.

3. The push-on switch according to claim 2, further including:

a central stationary contact which is disposed in a central area of a bottom face of said recess in said insulative body to be opposed to the top portion of said lower dome-like movable contact, wherein:

a first peripheral stationary contact which is disposed outside said central stationary contact, and which is always in contact with an outer peripheral edge portion of said lower dome-like movable contact; and a second peripheral stationary contact which is disposed outside said first peripheral stationary contact, and which is always in contact with an outer peripheral edge portion of said upper dome-like movable contact that is larger than said lower dome-like movable contact.

4. The push-on switch according to claim 2, wherein:

in said upper movable contact, legs are elongated continuously from four corners of an oval portion which is invertible, leg accommodating recesses which accommodate said legs of said upper movable contact are formed in four corners of said insulative body to be continuous to said recess, respectively, and a stationary contact which is always in contact with at least one of said legs is disposed in said leg accommodating recesses.

5. The push-on switch according to claim 1, wherein:

said legs elongate from said four corners of said invertible oval portion to be continuous in a longitudinal direction of said oval portion.

* * * * *